US006881882B2

(12) United States Patent
Ito et al.

(10) Patent No.: US 6,881,882 B2
(45) Date of Patent: Apr. 19, 2005

(54) STRING STRETCHING MECHANISM FOR STRINGED INSTRUMENT

(75) Inventors: Osamu Ito, Hamamatsu (JP); Kiyoshi Minakuchi, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/320,459

(22) Filed: Dec. 17, 2002

(65) Prior Publication Data

US 2003/0110920 A1 Jun. 19, 2003

(30) Foreign Application Priority Data

Dec. 19, 2001 (JP) ..... P 2001-386028

(51) Int. Cl.[7] ..... G10D 3/02
(52) U.S. Cl. ..... 84/298
(58) Field of Search ..... 84/298, 297 R, 84/299, 290

(56) References Cited

U.S. PATENT DOCUMENTS 4,539,886 A * 9/1985 Hoffart ..... 84/267
6,166,309 A * 12/2000 Hoshino ..... 84/298
6,552,252 B1 * 4/2003 Hirayama ..... 84/313
6,710,235 B1 * 3/2004 Hirayama ..... 84/313

FOREIGN PATENT DOCUMENTS

JP 2-119300 9/1990

* cited by examiner

*Primary Examiner*—Kimberly Lockett
(74) *Attorney, Agent, or Firm*—Dickstein, Shapiro, Morin & Oshinsky, LLP.

(57) ABSTRACT

A tremolo mechanism is arranged on the body of an electric guitar and is constituted by a tremolo arm, a bridge base, and plural bridge saddles, wherein the bridge base has a roughly T-shape constituted by a plate that is arranged above the exterior surface of the body, and a string stopper that is received in a hollow space of the body. Herein, the bridge saddles are arranged on the upper surface of the plate that is curved approximately in a convex shape whose curvature substantially matches the curvature of a fingerboard of a neck curved in the width direction. In addition, the bridge saddles are interconnected with the bridge base by octave adjustment screws, which are arranged beneath the plate using a prescribed attachment portion arranged inside of the hollow space of the body.

8 Claims, 5 Drawing Sheets

STRING STRETCHING MECHANISM FOR STRINGED INSTRUMENT

BACKGROUND OF THE INVENTION

1. Field of the Invention

This invention relates to string stretching mechanisms for stringed instruments, in particular to tremolo mechanisms of electric guitars.

2. Description of the Related Art

Conventionally, electric guitars have tremolo mechanisms, that is, string stretching mechanisms, which produce special sound effects called 'tremulous effects' by rapid reiteration of notes or by rapid alternation between notes, wherein tensions of strings are repetitively varied at relatively high frequencies (or in small periods) to slightly shift up and down pitches. This technique may be disclosed in various papers such as Japanese Unexamined Utility-Model Publication No. Hei 2-119300.

FIG. 6 shows a conventional example of a tremolo mechanism of an electric guitar, that is, a tremolo mechanism 1 that is arranged on a prescribed position of a body 2 of the guitar, wherein a bridge base 3 arranged on the body 2 is interconnected with a balance spring 4, which is embedded in the body 2. The bridge base 3 is balanced with the moment caused by tension T1 of a string 5, which is stretched above the body 2, by the balance spring 4. One end portion of the string 5 is supported by a bridge saddle 6 arranged on the bridge base 3, the front end portion of which is securely fixed to the body 2 by a support screw 8, wherein a contact point or area between the support screw 8 and the front end portion of the bridge base 3 acts as a fulcrum for a rotational movement of the bridge base 3, the back end portion of which is interlocked with a tremolo arm 7. By vertically moving the tremolo arm 7 in FIG. 6 up or down, the bridge base 3 is correspondingly moved up or down to temporarily break the balanced state established against the moment, so that the tension T1 of the string 5 is repetitively varied at a relatively high frequency. The string 5 has a ring 9 at one end thereof, which may be normally called a "ball end" that is stopped beneath the lower portion of the bridge base 3. The intermediate portion of the string 5 is stretched and supported between the bridge saddle 6 and a nut of a neck (not shown), and the other end of the string 5 is stopped and wound about a winder of a tuning peg arranged in a head (not shown).

The bridge saddle 6 can be arbitrarily adjusted in height above the bridge base 3 by two height adjustment screws 10. In addition, the bridge saddle 6 is also arranged to be freely moved forward and backward above the bridge base 3. That is, the bridge saddle 6 is interconnected with the back end portion of the bridge base 3 to be freely moved forward and backward by an octave adjustment screw 11, which is used to adjust intonation of the string 5, wherein the bridge saddle 6 is normally pulled backwardly by a spring 12. Generally, it can be said that accurate intonation is established when accurate pitches can be normally produced by fingering the string 5 at all frets of the neck of a guitar. Musicians may judge the intonation based on lengths of strings, overall curves of necks, used states or oldness of strings, and the like. A projecting portion 3A is integrally formed at the back end portion of the bridge base 3 and is interconnected with the octave adjustment screw 11. In addition, a string stopper 3B projects downwardly from the lower portion of the bridge base 3, so that one end portion of the string 5 is inserted through the string stopper 3B, which is arranged in a spring receiving hollow 13 of the body 2 of the guitar and is also used to stop one end of the balance spring 4.

The conventional tremolo mechanism 1 described above requires a relatively large number of parts and has a complicated structure, which raises a problem that a relatively long time may be required for manufacture and adjustment. Normally, the neck of the guitar is slightly curved in a convex shape in the direction perpendicular to the longitudinal direction in which six strings are arranged and stretched, so that the fingerboard of the neck is correspondingly curved. That is, all strings may slightly differ from each other in heights above the fingerboard of the neck of the guitar, wherein the strings arranged approximately in the center area in the width direction of the neck have higher heights while the other strings arranged in peripheral areas in the width direction of the neck have lower heights. On the other hand, an upper surface 3*a* of the bridge base 3 is normally formed planar. Therefore, it is necessary to perform fine adjustment on strings in response to their heights. This requires two height adjustment screws 10 for use in adjustment of the height of the bridge saddle 6, which is supported above the upper surface 3*a* of the bridge base 3. For this reason, the number of parts should be correspondingly increased; and a relatively long time should be required for adjustment of the height of the bridge saddle 6 above the bridge base 3.

Since the height adjustment screw 10 vertically penetrates through the prescribed position of the bridge saddle 6, there is a possibility that the upper end of the height adjustment screw 10 will be projected upwardly to be considerably higher than the upper surface of the bridge saddle 6 in adjustment, which may cause problems in that player's hand would be easily brought into contact with the height adjustment screw 10 during the playing of the guitar. In addition, unwanted vibration and noise may be caused due to the increased number of parts particularly arranged in the tremolo mechanism 1. In order to interconnect the back end portion of the bridge saddle 6 with the bridge base 3 by the octave adjustment screw 11, it is necessary to form the projecting portion 3A integrally at the back end portion of the bridge base 3. That is, the projecting portion 3A as well as the octave adjustment screw 11 and the height adjustment screw 10 should be apparently arranged on the body 2 of the guitar, which may deteriorate visual appearance of the tremolo mechanism 1.

SUMMARY OF THE INVENTION

It is an object of the invention to provide a string stretching mechanism for a stringed instrument, particularly, an electric guitar, which is simplified in structure by reducing the number of parts and which does not require complicated adjustments with respect to heights of strings. Thus, it is possible to noticeably improve the performability and exterior design of the stringed instrument, particularly in the tremolo mechanism, compared with conventional mechanisms.

This invention provides a brand-new string stretching mechanism for a stringed instrument, in particular, a tremolo mechanism for an electric guitar. The prescribed number of strings are arranged and stretched over the neck between the head of the guitar and the tremolo mechanism that is arranged on the body of the guitar. In the tremolo mechanism, plural bridge saddles are mounted on a bridge base, which is arranged on the body of the guitar, and are arranged in the direction substantially perpendicular to the string stretching direction in which the strings are each stretched over the neck.

Specifically, the bridge base has a roughly T-shape constituted by a plate that is arranged above the body of the guitar, and a string stopper that projects downwardly from the plate and is received in a hollow space formed in the body of the guitar. The upper surface of the plate is curved approximately in a convex shape whose curvature substantially matches the curvature of the fingerboard of the neck curved in the width direction, so that the bridge saddles are mounted and arranged on the curved upper surface of the plate of the bridge base. Ends of the strings are stopped in through holes that are formed to penetrate through the plate and string stopper in the hollow space of the body of the guitar, wherein the bridge base is normally balanced and fixed in position by balance springs, interconnected with the end portion of the string stopper in the hollow space of the body of the guitar, in such a way that the moment caused by the tension applied to each string is well balanced with the moment caused by the force of the balance spring. When a tremolo arm attached to the plate of the bridge base is vertically moved, the bridge base is correspondingly moved pivotally about the prescribed rotation fulcrum(s) in the string stretching direction, so that the tension of the string can be repeatedly changed at a relatively high frequency.

In addition, the bridge saddles are interconnected with the bridge base by octave adjustment screws, which are arranged beneath the plate using the prescribed attachment portion partially or entirely arranged inside of the hollow space of the body of the guitar. By manually operating the octave adjustment screws, it is possible to adjust positional relationships of the bridge saddles for supporting end portions of the strings.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1A:
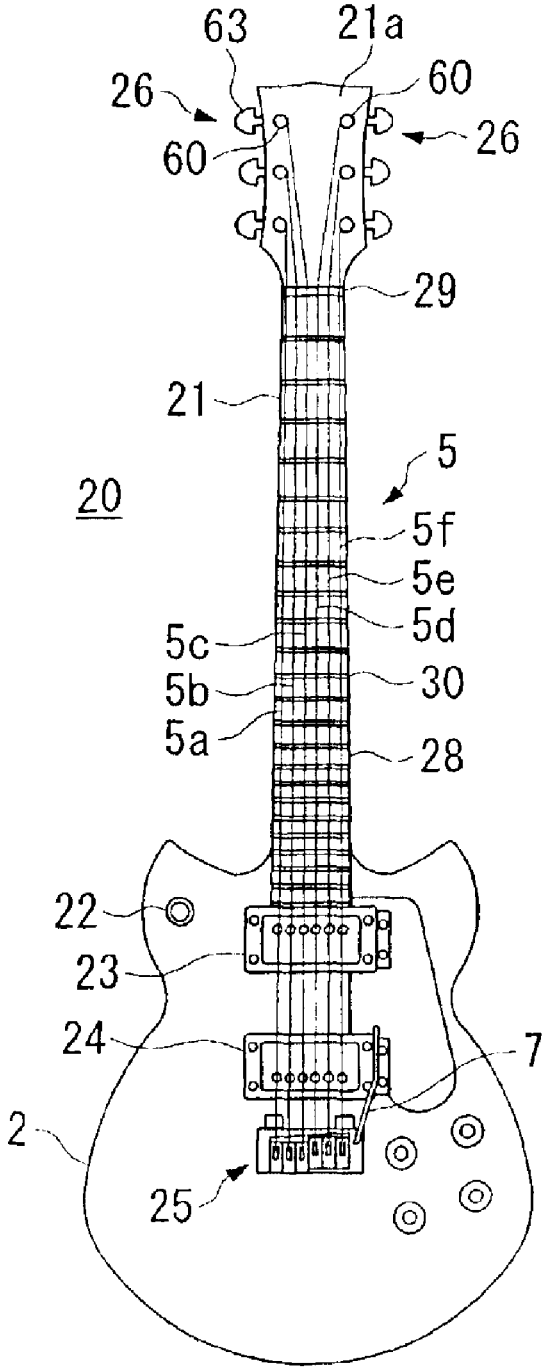
FIG. 1A is a front view of an electric guitar incorporating a tremolo mechanism in accordance with a preferred embodiment of the invention.
Figure 1B:
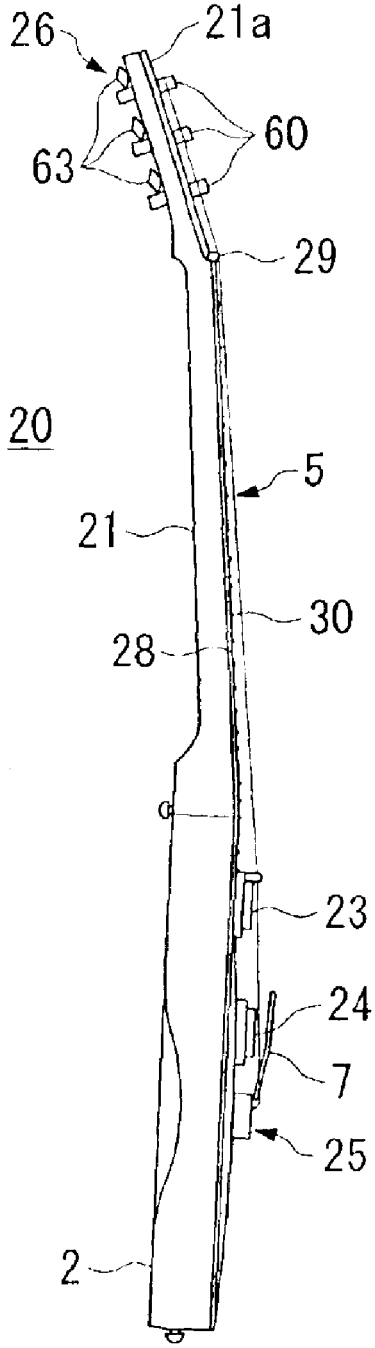
FIG. 1B is a side view of the electric guitar.
Figure 2:
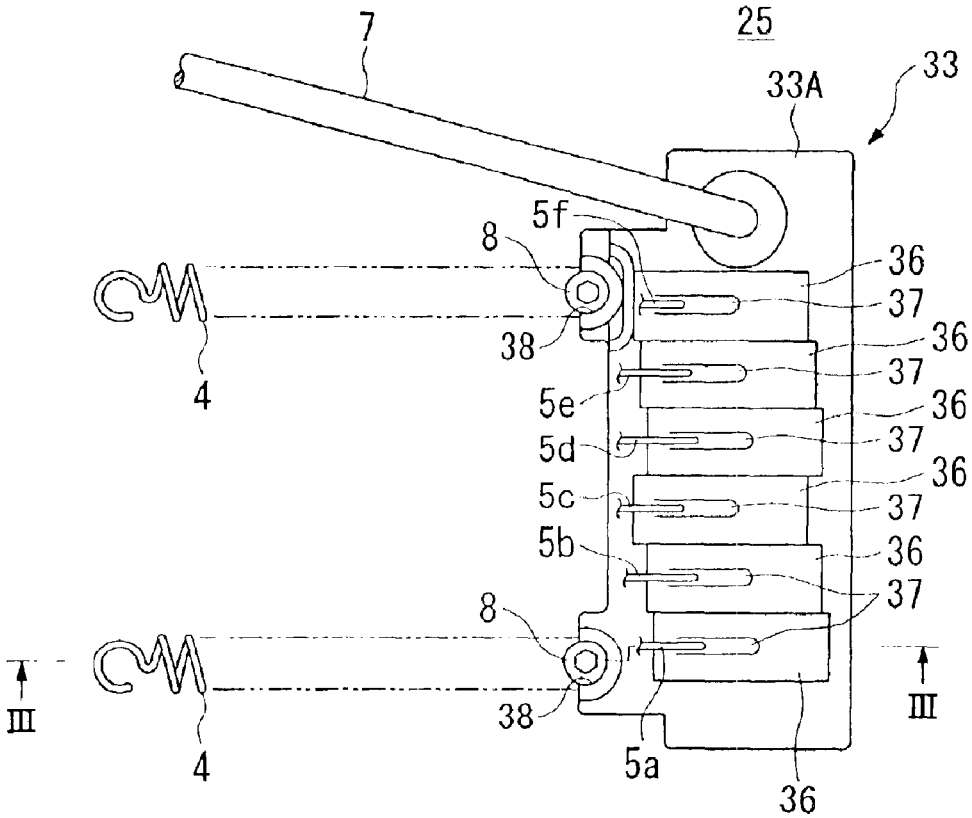
FIG. 2 is a plan view of the tremolo mechanism of the electric guitar.
Figure 3:
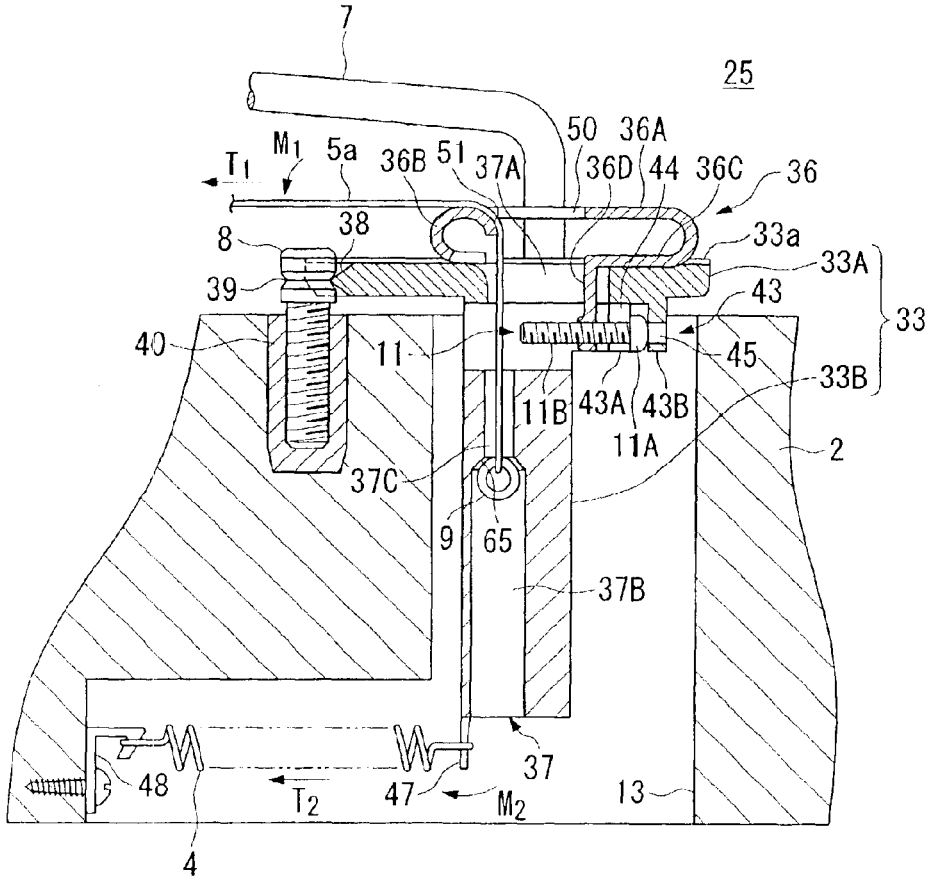
FIG. 3 is a cross sectional view of the tremolo mechanism taken along the line III—III in FIG. 2.
Figure 4:
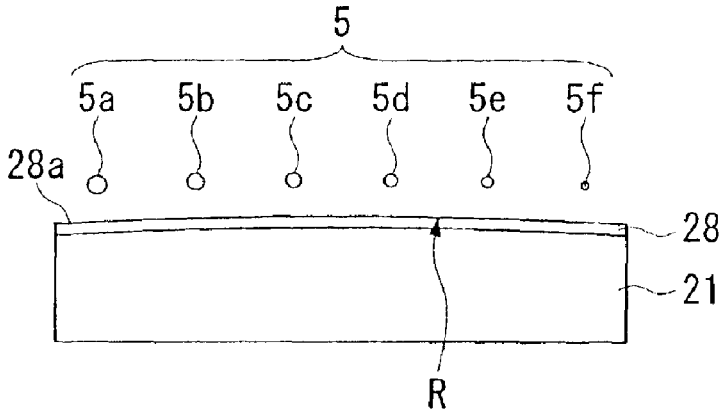
FIG. 4 is a cross sectional view of a neck of the electric guitar.
Figure 5:
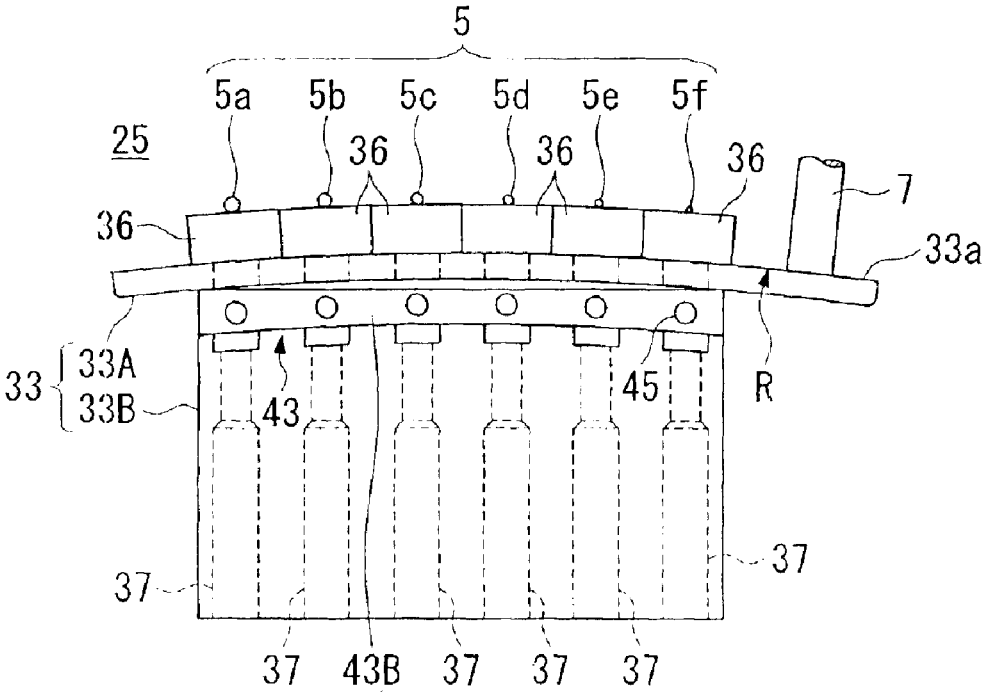
FIG. 5 is a back view of the tremolo mechanism of the electric guitar.
Figure 6:
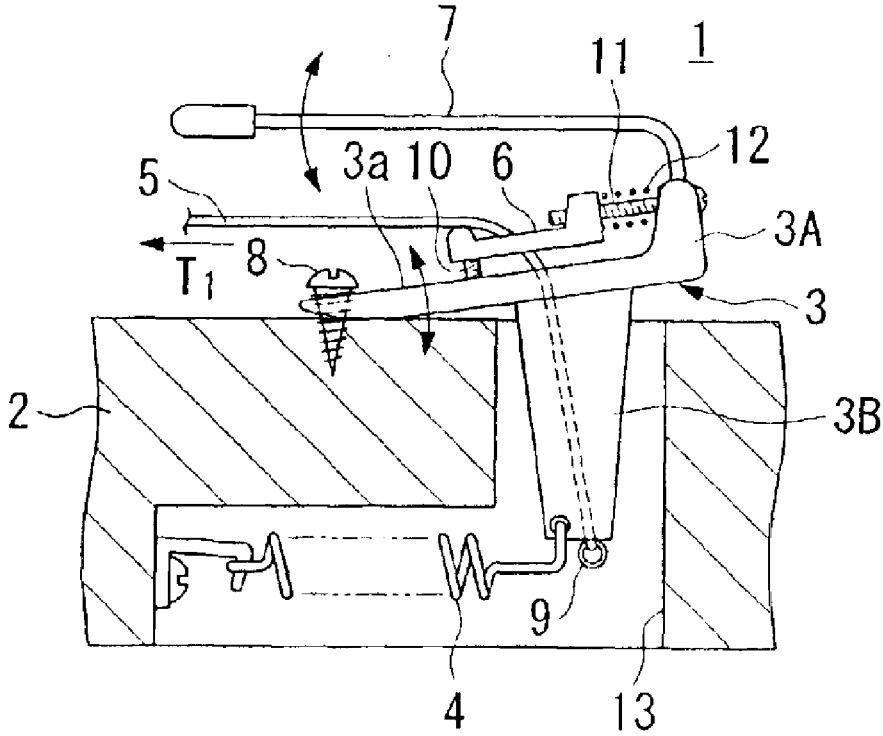
FIG. 6 is a cross sectional view showing the overall structure of a tremolo mechanism conventionally used in an electric guitar.

FIGS. 1A and 1B are front and side views of an electric guitar, which incorporates a tremolo mechanism in accordance with the preferred embodiment of the invention. FIG. 2 is a plan view of the tremolo mechanism; FIG. 3 is an enlarged cross sectional view taken along the line III—III in FIG. 2; FIG. 4 is a cross sectional view of a neck of the electric guitar; and FIG. 5 is a back view of the tremolo mechanism. In these figures, parts identical to those shown in FIG. 6 are designated by the same reference numerals; hence, the detailed description thereof will be omitted as necessary.

That is, an electric guitar 20 shown in FIGS. 1A and 1B is basically constituted by a solid-type body 2 and a neck 21, over which six strings 5*a*–5*f* (all represented by the same reference numeral '5') are arranged and stretched in prescribed positions. In addition, a pickup switch 22 and a pair of pickups 23 and 24 for converting vibrations of the strings 5 into electric signals, and a tremolo mechanism 25 for stopping ends of the strings 5 are arranged on the front surface of the body 2 of the electric guitar 20. Further, six winders 26 for respectively stopping the other ends of the strings 5 are arranged in a head 21*a* of the neck 21 and are interconnected with tuning pegs. A fingerboard 28 is joined with the surface of the neck 21, wherein the boundary between the neck 21 and the head 21*a* is defined by a nut (or an upper bridge) 29, and the prescribed number of frets 30 are arranged on the fingerboard 28 in the longitudinal direction by prescribed distances therebetween, so that the nut 29 and the frets 30 are all elongated in the width direction of the neck 21 substantially perpendicular to the strings 5 arranged over the neck 21. A surface 28*a* of the fingerboard 28 is slightly curved in the width direction of the neck 21 substantially perpendicular to the strings 5 arranged over the neck 21 as shown in FIG. 4, wherein it is curved in a convex shape having a curvature R. For this reason, the center portion of the neck 21 in the width direction becomes higher in height, while peripheral portions become lower in height. The nut 29 is arranged between the neck 21 and the head 21*a*.

The tremolo mechanism 25 shown in FIGS. 2 and 3 has a bridge base 33, which is arranged on the body 2 of the guitar and can be freely swung or pivotally moved as necessary. The bridge base 33 has roughly a T-shape in a side view (see FIG. 3), wherein it is constituted by a plate 33 having a rectangular shape in cross section, which is elongated in a direction perpendicular to a string stretching direction, and a string stopper 33B that is shaped like a block and is projected downwardly from approximately the lower center of the plate 33A. In addition, the bridge base 33 has six through holes 37, into which one end portions of the six strings 5 are respectively inserted. The through holes 37 each penetrate through the bridge base 33 at prescribed positions, wherein each of them has an opening at the upper surface of the plate 33A, and another opening at the lower surface of the string stopper 33B. In addition, each of the through holes 37 has different diameters, and it is constituted by three sections, namely, an elongated hole section 37A that is elongated in the string stretching direction and is formed to completely penetrate through the plate 33A and to partially penetrate into the upper portion of the string stopper 33B, a large diameter section 37B that is formed to penetrate through the string stopper 33B from the upper portion to the lower portion to provide an opening, and a small diameter section 37C for interconnecting between the elongated hole section 37A and the large diameter section 37B. In addition, the elongated hole section 37A provides an additional opening that is opened in the backside of the string stopper 33*b* to allow insertion and attachment of octave adjustment screws 11.

An upper surface 33*a* of the plate 33A is curved using a prescribed curvature R in a convex shape in the direction perpendicular to the string stretching direction (see FIG. 4). That is, the upper surface 33*a* of the plate 33A is a convexly curved surface that substantially matches the aforementioned surface 28*a* of the fingerboard 28. As shown in FIG. 2, six bridge saddles 36 are arranged in parallel in the direction perpendicular to the string stretching direction, wherein they support one end portions of the six strings 5 respectively. In addition, a tremolo arm 7 is planted on a prescribed position on the plate 33A in proximity to the parallel arrangement of the bridge saddles 36. Specifically, the tremolo arm 37 is located at the side end portion of the upper surface 33*a* of the plate 33A in proximity to the bridge saddle 36 for supporting a string 5*f* having the highest pitch. The front end portion of the plate 33A is slightly elongated forwardly to provide locations for rotation fulcrum portions 38, which are respectively arranged in proximity to the bridge saddles 36 for supporting strings 5*a* and 5*f* respectively and about which the bridge base 33 as a whole can rotate. Each of the rotation fulcrum portions 38 corresponds to a recess having a hemispherical shape in a plan view, wherein the internal wall thereof is cut in a V-shape to clearly indicate a rotation fulcrum for the bridge base 33 and is engaged with a V-shaped ring channel 39 of the support screw 8. The thread portion of the support screw 8 is screwed into a metal nut that is embedded under the surface of the body 2 of the guitar, and the head of the support screw 8 is projected above the surface of the body 2 of the guitar, wherein the aforementioned ring channel 39 is formed in the outer circumference of the head of the support screw 8.

An attachment portion 43 allowing attachment of the octave adjustment screws 11 is formed integrally with the plate 33A of the bridge base 33, wherein it is elongated in the direction perpendicular to the string stretching direction and is projected downwardly from the under surface of the plate 33 in the backward area of the string stopper 33B. Specifically, the attachment portion 43 is constituted by a pair of elongated projections 43A and 43B, which are projected downwardly from the under surface of the plate 33A and are arranged back and forth. Herein, the front-side projection 43A arranges six holes 44, each having an inverted U-shape, in relation to the six bridge saddles 36 respectively, wherein the octave adjustment screws 11 are respectively inserted into and engaged with the holes 44. The back-side projection 43B arranges six holes 45 in relation to the six bridge saddles 36 respectively, wherein hexagonal wrenches (not shown) are respectively inserted into the holes 45 and are operated to rotate the octave adjustment screws 11 respectively.

The octave adjustment screws 11 are each inserted into lower openings of the attachment portion 43 in such a way that heads 11A thereof are placed between the projections 43A and 43B while thread portions 11B thereof are inserted into the holes 44 of the front-side projection 43A and are engaged with the bridge saddles 36 respectively. Hence, it is possible to interconnect the bridge saddles 36 with the attachment portion 43 via the octave adjustment screws 11. In other words, the octave adjustment screws 11 are used to interconnect the bridge saddles 36 with the bridge base 33 in the back end side of the under surface of the plate 33A. For this reason, the player or user of the electric guitar cannot visually recognize the octave adjustment screws 11 in the upper side of the bridge base 33. Since the octave adjustment screws 11 are arranged below the under surface of the plate 33A, it is unnecessary to form a projection and the like integrally at the back end side of the upper surface of the plate 33A. Since the heads 11A of the octave adjustment screws 11 are placed between the projections 43A and 43B of the attachment portion 43, it is possible to easily regulate movements of the octave adjustment screws 11 in forward and backward directions. Therefore, even when the strings 5 are removed from the tremolo mechanism 25 of the electric guitar, it is highly unlikely that the bridge saddles 36 are unexpectedly moved in forward and backward directions together with the octave adjustment screws 11. Thus, it is possible to omit provision of the aforementioned spring 12 accompanied with the octave adjustment screw 11 shown in FIG. 6.

The string stopper 33B of the bridge base 33 is inserted into a spring receiving hollow 13, which penetrates through the body 2 of the guitar from the front surface to the back surface, in such a way that it can be freely slanted or moved slantingly therein. A spring stopper 47 for stopping one ends of balance springs 4 is integrally formed with the string stopper 33B and is projected downwardly in the spring receiving hollow 13. The balance springs 4 are each constituted by a tension coil spring, one end of which is stopped by the spring stopper 47 and the other end of which is stopped by a hook 48 that is fixed to a prescribed position of the interior wall of the spring receiving hollow 13.

The bridge saddles 36 are each formed by folding and bending processes of a metal plate, so that they are each constituted by four sections, namely, a main portion 36A that is elongated in the string stretching direction, a pair of support legs 36B and 36C that are formed by folding the front and back sides of the main portion 36A, and an interconnecting portion 36D that is formed by bending the tip end of the back-side support leg 36C downwardly (see FIG. 3). A string channel 50 that is a slit elongated in the string stretching direction is formed approximately about the width center of the main portion 36A of the bridge saddle 36. In addition, a string receiving portion 51 that is bent like a quarter of a circular arc slightly downwardly from the front side of the main portion 36A is arranged at the front end of the string channel 50 in order to avoid occurrence of a break or disconnection of the string 5. A pair of the support legs 36B and 36C are directly mounted on the upper surface 33*a* of the plate 33A to support the main portion 36A of the bridge saddle 36 at a prescribed height. The interconnecting portion 36D of the bridge saddle 36 is inserted into the elongated hole section 37A of the bridge base 33 from the above and is arranged in the front side of the attachment portion 43. In addition, a tapped hole, into which the thread portion of the octave adjustment screw 11 is screwed, is formed at the lower portion of the interconnecting portion 36D of the bridge saddle 36. Therefore, when the octave adjustment screw 11 is rotated by manipulating the corresponding wrench (not shown), the bridge saddle 36 is moved in the string stretching direction along the upper surface 33*a* of the plate 33A, so that the string 5 is adjusted in intonation. In order to rotate the octave adjustment screw 11, the bridge base 33 is rotated about the fulcrums corresponding to the rotation fulcrum portions 38 so that the attachment portion 43, which is normally inserted into the spring receiving hollow 13, is slightly lifted upwardly above the surface of the body 2 of the guitar. Incidentally, the bridge saddle 36 is not necessarily produced by folding and bending processes; hence, it can be produced by other processes such as die casting processes.

In the aforementioned tremolo mechanism 25, the plate 33A of the bridge base 33 is arranged above the exterior surface of the body 2 of the guitar, and the string stopper 33B is arranged inside of the spring receiving hollow 13 formed in the body 2 of the guitar. In addition, the strings 5 are each arranged and stretched between the winders 26 of the tuning pegs and the bridge base 3 and are each imparted with prescribed tension T1. Under the stretched state of the string 5, the bridge base 33 is supported to be pivotally moved or vertically rotated about the support screw 8 having the ring channel 39 to which the rotation fulcrum portion 38 is pressed due to the tension T1 of the string 5 and the tension T2 of the balance spring 4. That is, the bridge base 33 is normally applied with moment M1 due to the tension T1 of the string 5 and moment M2 due to the tension (or spring force) T2 of the balance spring 4, wherein the moments M1 and M2 are substantially identical to each other and are effected in reverse directions respectively. Therefore, the bridge base 33 is normally held horizontally above the body 2 of the guitar due to a balanced relationship between the moments M1 and M2 (or a balanced relationship between the tensions T1 and T2).

Ball ends 9 are attached to one ends of the strings 5 respectively and are each stopped in the through hole 37 of the bridge base 33, while the other ends of the strings 5 are stopped and wound about the winders 26 of the tuning pegs, which are well known and conventionally used in guitars. That is, the winders 26 are each constituted by a winding shaft 60 that is (partly) embedded in the head 21*a* and can be freely rotated in response to manual operation of a tuning peg, a worm-wheel (not shown) that is arranged about the winding shaft 60, and an operator (or tuning peg) 63 having a worm engaged with the worm-wheel. By manually rotating the operator 63, the winding shaft 60 is correspondingly rotated so that the other end portion of the string 5 is wound up about the winder 26. By tightly winding or loosely winding the string 5 by the winder 26, it is possible to increase or decrease the tension of the string 5, so that the player (or user) can freely adjust the string 5 at a prescribed interval (or pitch).

In order to arrange and stretch the strings 5 between the tremolo mechanism 25 and the winders 26, end portions of the strings 5 are firstly inserted into the through holes 37 of the bridge base 33 from the under surface side of the body 2 of the guitar, wherein they are pulled up and hooked on the string channels 50 of the corresponding bridge saddles 36 and are drawn from the body 2 to the head 21*a* of the guitar across the neck 21 in the longitudinal direction; then, they are respectively wound about the winders 26 and are stopped to provide prescribed tensions therefor. When each of the strings 5 is each stretched between the tremolo mechanism 25 and the head 21*a* of the guitar, the ball end 9 is stopped being pressed against a prescribed difference, which is formed between the large diameter section 37B and the small diameter section 37C of the through hole 37 due to the tension applied to the string 5. A prescribed end portion of the string 5 close to the ball end 9 is pulled out from the string channel 50 and is supported by the string receiving portion 51, while the other end portion of the string 5 arranged close to the winder 26 is supported on the upper surface of the nut (or upper bridge) 29.

As described above, the electric guitar 20 of the present embodiment is designed in such a way that the upper surface 33*a* of the bridge base 33 is curved in a prescribed convex shape whose curvature 'R' substantially matches the curvature of the 'curved' surface 28*a* of the fingerboard 28. Therefore, when the six bridge saddles 26 are arranged in the direction perpendicular to the string stretching direction, it is possible to secure substantially the same heights for the bridge saddles 36 in relation to the strings 5 respectively, which is shown in FIGS. 4 and 5. This eliminates the necessity of adjusting the height of the bridge saddle 36 using two height adjustment screws 10 shown in FIG. 6. Therefore, it is possible to reduce the number of parts required in the tremolo mechanism 25 and to simplify the structure of the tremolo mechanism 25. In addition, it is possible to realize easiness in attachment and adjustment of the bridge saddles 36 on the bridge base 33 in a relatively short period of time.

Since the electric guitar 20 of the present embodiment does not require height adjustment screws 10 that are conventionally required, the player (or user) is not necessarily concerned that his/her hand would be unexpectedly brought into contact with the height adjustment screw(s) 10 when playing the electric guitar. Thus, it is possible to improve the performability in playing the electric guitar.

In addition, the present embodiment is characterized in that the octave adjustment screws 11, which securely interconnect the bridge saddles 36 to the bridge base 33 and which allows regulated movements and positional adjustments of the bridge saddles 36 relative to the bridge base 33, are arranged beneath the plate 33A of the bridge base 33. Therefore, the player (or user) may not have direct visual contacts with the octave adjustment screws 11 from the upper side of the plate 33A, wherein the attachment portion 43 for attaching the octave adjustment screws 11 is not required to be projected above the upper surface 33*a* of the plate 33A. Thus, it is possible to noticeably improve the exterior appearance of the tremolo mechanism 25 of the electric guitar.

The present embodiment is designed in such a way that, as shown in FIG. 3, the ball end 9 of the string 5 is stopped inside of the through hole 37 of the string stopper 33B of the bridge base 33 within the body 2 of the guitar. However, it is possible to modify the present embodiment in such a way that, as shown in FIG. 6, the ball end 9 is stopped at the lower surface of the string stopper 33B.

As described heretofore, this invention has a variety of effects and technical features, which will be described below.

(1) This invention eliminates the necessity of arranging height controls on bridge saddles. Therefore, it is possible to reduce the number of parts required in the tremolo mechanism of the electric guitar, which is simplified in structure and which also results in reduction of the manufacturing cost. In addition, the human operator or worker can easily attach and adjust the bridge saddles in the tremolo mechanism of the electric guitar in manufacture.

(2) This invention arranges octave adjustment screws beneath the plate of the bridge base attached to the body of the guitar. Hence, it is possible to avoid direct visual contact with the octave adjustment screws from the upper side of the body of the guitar. Thus, it is possible to noticeably improve the exterior appearance of the tremolo mechanism of the electric guitar, that is, the exterior appearance of the string stretching mechanism of the stringed instrument.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A string stretching mechanism for a stringed instrument, comprising:

a bridge base for stopping one end of each of a plurality of strings, which is arranged on an exterior surface of a body of the stringed instrument and can be pivotally moved in a string stretching direction in which the strings are arranged and stretched over a neck; and a plurality of bridge saddles for supporting one end of each of the strings respectively, which are arranged on the bridge base in a direction substantially perpendicular to the string stretching direction, wherein an upper surface of the bridge base is curved in a convex shape whose curvature substantially matches a curvature of a fingerboard on the neck of the stringed instrument so that the plurality of bridge saddles are mounted on the upper surface of the bridge base and arc interconnected with the bridge base by a plurality of octave adjustment screws in such a way that the plurality of bridge saddles can be each adjusted in position in the string stretching direction.

2. The string stretching mechanism for a stringed instrument according to claim 1, wherein the bridge base is constituted by a plate on which the plurality of bridge saddles are mounted, a string stopper that projects downwardly from the plate and is inserted into a hollow space formed in the body of the stringed instrument, and a plurality of through holes that are formed to penetrate through the plate and the string stopper in which one end of each of the strings are stopped, and wherein the plurality of bridge saddles are interconnected with the bridge base by the plurality of octave adjustment screws beneath the plate.

3. The string stretching mechanism for a stringed instrument according to claim 2, wherein an attachment portion for attaching the octave adjustment screws is arranged beneath the plate.

4. The string stretching mechanism for a stringed instrument according to claim 1 or 2, wherein an arm is attached to the plate of the bridge base in proximity to an arrangement of the plurality of bridge saddles, so that when the arm is vertically moved, the bridge base is correspondingly moved pivotally about a prescribed rotation fulcrum, so that tension applied to each of the strings is temporarily changed.

5. The string stretching mechanism for a stringed instrument according to claim 1 or 2, wherein one end of the plate of the bridge base is securely fixed to the body by a plurality of support screws whose threads arc embedded in the body, and the string stopper of the bridge base is interconnected with a plurality of balance springs that are arranged in the hollow space of the body to normally establish balanced states with respect to the plurality of strings respectively, and wherein when an arm attached to the plate of the bridge base in proximity to an arrangement of the plurality of bridge saddles is vertically moved, the bridge base is correspondingly moved pivotally about prescribed rotation fulcrums corresponding to the support screws, so that tension applied to each of the strings is temporarily changed.

6. The string stretching mechanism for a stringed instrument according to claim 3, wherein the attachment portion is constituted by a pair of projections that project downwardly from an under surface of the plate of the bridge base and that are arranged in parallel via a prescribed gap therebetween, so that heads of the octave adjustment screws whose threads are interconnected with the plurality of bridge saddles respectively are each arranged in the gap between the pair of projections, and wherein a plurality of holes are formed to penetrate through the projection, which is arranged backwardly from the other projection, to allow the octave adjustment screws to be respectively operated.

7. A stringed instrument, comprising:

a body;

a neck connected to and extending from the body;

a plurality of strings that are stretched along the length of the neck; and a string stretching mechanism, comprising:

a bridge base for stopping one end of each of the plurality of the strings, the bridge base being arranged on an exterior surface of the body of the stringed instrument and can be pivotally moved in a string stretching direction in which the strings are arranged and stretched over the neck, and a plurality of bridge saddles for supporting one end of each of the strings respectively, each of the bridge saddles being arranged on the bridge base in a direction substantially perpendicular to the string stretching direction, wherein an upper surface of the bridge base is curved in a convex shape whose curvature substantially matches a curvature of a fingerboard on the neck of the stringed instrument so that the plurality of bridge saddles are mounted on the upper surface of the bridge base and are interconnected with the bridge base by a plurality of octave adjustment screws in such a way that the plurality of bridge saddles can be each adjusted in position in the string stretching direction.

8. The stringed instrument according to claim 7, wherein the bridge base of the string stretching mechanism is constituted by a plate on which the plurality of bridge saddles are mounted, a string stopper that projects downwardly from the plate and is inserted into a hollow space formed in the body of the stringed instrument, and a plurality of through holes that are formed to penetrate through the plate and the string stopper in which one end of each of the strings are stopped, and wherein the plurality of bridge saddles are interconnected with the bridge base by the plurality of octave adjustment screws beneath the plate.

* * * * *